United States Patent [19]

Vits

[11] 3,941,374

[45] Mar. 2, 1976

[54] ARRANGEMENT FOR THE STACKWISE DEPOSITING OF SEPARATE EQUALLY-LONG SHEETS ON A REPOSITORY

[75] Inventor: Hilmar Vits, Leichlingen, Germany

[73] Assignee: VITS-Maschinenbau GmbH, Langenfeld, Germany

[22] Filed: Sept. 24, 1974

[21] Appl. No.: 508,910

[30] Foreign Application Priority Data

Sept. 26, 1973 Germany ..... 2348320

[52] U.S. Cl. ..... 271/183; 271/196

[51] Int. Cl.[2] ..... B65H 29/68

[58] Field of Search ..... 271/182, 183, 194, 196

[56] References Cited

UNITED STATES PATENTS

| | | | |
|---|---|---|---|
| 3,432,161 | 3/1969 | Dale et al. | 271/183 |
| 3,545,746 | 12/1970 | Ledger et al. | 271/196 |
| 3,659,839 | 5/1972 | Baucke | 271/183 |
| 3,774,907 | 11/1973 | Borostyan | 271/196 |

*Primary Examiner*—Evon C. Blunk
*Assistant Examiner*—Robert Saifer
*Attorney, Agent, or Firm*—Haseltine, Lake & Waters

[57] ABSTRACT

An arrangement for the stackwise depositing of individual sheets of equal lengths in a repository or file by means of a conveying arrangement which includes one or more vacuum conveyor rolls or webs, adapted to transport successive sheets which are introduced in a time sequence from an input to the repository at a definite conveying speed, and including a braking installation located preceding or ahead of the repository, which deflects the end of each sheet downwardly out of the plane of conveyance and reduces the conveying speed to a speed which provides for an undisturbed deposition, and wherein the aspirating effect of a vacuum conveying roll which is located in proximity to the braking installation is interrupted during actuation of the braking installation. In an arrangement pursuant to the above-mentioned type, the vacuum conveying roll, which is located in proximity to the brake arrangement, is perforated for only a portion of its periphery, and so rotates in rhythm with the insertion of the sheets, that the perforated peripheral portion of the vacuum roll runs synchronously with the leading or initial portion of each sheet, and the unperforated peripheral portion of the vacuum roll faces towards the end or trailing portion of each sheet, when the sheet end is located within the effective range of the brake arrangement operating in rhythm with the sheet insertion.

8 Claims, 6 Drawing Figures

ARRANGEMENT FOR THE STACKWISE DEPOSITING OF SEPARATE EQUALLY-LONG SHEETS ON A REPOSITORY

FIELD OF THE INVENTION

The present invention relates to an arrangement for the stackwise depositing of individual sheets of equal lengths in a repository or file by means of a conveying arrangement which includes one or more vacuum conveyor rolls or webs, adapted to transport successive sheets which are introduced in a timed sequence from an input to the repository as a definite conveying speed, and including a braking installation located preceding or ahead of the repository, which deflects the end of each sheet downwardly out of the plane of conveyance and reduces the conveying speed to a speed which provides for an undisturbed deposition, and wherein the aspirating effect of a vacuum conveying roll which is located in proximity to the braking installation is interrupted during actuation of the braking installation.

DISCUSSION OF THE PRIOR ART

In a known arrangement of this type, immediately preceding the repository and below the plane of conveyance, there are positioned two vacuum rolls which are perforated about their entire periphery, and which are connected to vacuum blowers including switching elements for the air stream. The first vacuum roll located in the conveying direction has its periphery tangential to the plane of conveyance and serves as a transport roll, in view of which its peripheral speed is equal to the conveying speed of the sheets. The second vacuum roll in the direction of conveyance has its periphery tangent with the plane of conveyance, or is somewhat downwardly offset. This second roll serves as a brake roll, in view of which its peripheral speed is lower than the conveying speed of the sheets. The switching elements which control the air stream of the vacuum blowers connected to these vacuum rolls, are selectively actuatable through the intermediary of a control arrangement. Located along the plane of conveyance and above the brake roll are blower bars with downwardly oriented blowing directions, whose air flow is also actuatable through the above-mentioned control arrangement.

The prior art arrangement operates in the following manner:

From a conveyor installation which consists of float bars which blow against the sheets from downwardly thereof and vacuum conveyor rolls, the sheets are transported in succession at a definite conveying speed from an inlet to a repository. Along the conveying path, the trailing end of the sheet is scanned by means of a light barrier which transmits a control signal to the switching elements in the air flow of the vacuum blowers. While considering the time which is required by the end of the sheet for the extent of movement between the light barrier and the vacuum brake roll, through the control installation there is interrupted the aspirating effect of the vacuum transport roll, the latter of which is positioned immediately ahead of the vacuum brake roll, and the suction or aspirating effect of the vacuum brake roll is activated, and concurrently the air flow of the blower bar which is located above the vacuum brake roll is activated, so that the end of the sheet which is currently located between the blower and the vacuum brake roll is downwardly deflected and pressed against the vacuum brake roll. Due to the peripheral speed of the vacuum brake roll in comparison with the sheet conveyance speed, the speed of the sheet from that end thereof is reduced to a magnitude so as to be able to be uninterruptedly deposited. Moreover, through the downward deflection of the sheet end, the plane of conveyance is freed for the inlet of the subsequent sheet, whereby the sheets overlap even before reaching their final positions in the repository. The sequential speed of the sheets is limited by the switching arrangement of the vacuum blowers and the vacuum brake roll, which is controlled by the light barrier, as shown in German Laid-Open Pat. Specification No. 2,021,375.

SUMMARY OF THE INVENTION

Accordingly, it is an object of the present invention to provide an arrangement for the stacklike depositing of individual sequentially transported sheets which permits at even higher, previously unattainable, sequential speeds of the sheets, a satisfactory depositing of the sheets.

The foregoing object is inventively attained in an arrangement pursuant to the above-mentioned type, in that the vacuum conveying roll, which is located in proximity to the brake arrangement, is perforated for only a portion of its periphery, and so rotates in rhythm with the insertion of the sheets, that the perforated peripheral portion of the vacuum roll runs synchronously with the leading or initial portion of each sheet, and the unperforated peripheral portion of the vacuum roll faces towards the end or trailing portion of each sheet, when the sheet end is located within the effective range of the brake arrangement operating in rhythm with the sheet insertion.

Since at a definite conveying speed of the sheets, the only part-peripherally perforated vacuum conveying roll, for example, perforated for its semi-periphery, rotates in rhythm with the sheet insertion, each of the peripheral sections thereof may be brought into a predetermined relative position with respect to each sheet, in which the leading or inlet end of equally long sheet is subjected to the transporting effect of the vacuum conveying roll, while the end or trailing portion of the same sheet is not subjected to the effect of this vacuum conveying roll, so that the braking effect and the downward deflection of the sheet can be undisturbedly carried out. In-and-out switchable means are consequently not required. On the basis of the foregoing, the inventive arrangement, in comparison with known arrangements, operates at considerably higher sheet sequential speeds.

Preferably, the braking element is a vacuum roll, whose peripheral speed is smaller, for example, ⅛ that of, respectively, the transport speed of each sheet imparted thereto by the vacuum conveying rolls.

For effecting the downward deflection of each sheet there are provided different possibilities. Basically, it would be possible that the deflection be carried out only through blow air, which becomes effective in rhythm with the introduced sheet. Preferably, however, the brake arrangement includes, for deflection of each sheet, cams which are located above the plane of conveyance and which extend into the plane of conveyance during each rotation, which can support blow nozzles, and/or may be shaped as spiral discs. In this embodiment of the invention there are similarly not required any in-and-out switchable elements, but only rotating components, so that from this aspect there is also permitted a high sheet sequence speed.

Suitably, the vacuum conveying roll, which is located in proximity to the brake arrangement, is located behind or downstream of the brake arrangement in the transporting direction. Such an arrangement permits that the sheets, until encountering the effectiveness of the brake arrangement, have a definite orientation with respect to the brake arrangement running in the same rhythm therewith. For the satisfactory operation of the inventive arrangement it is essential that the transported sheets, upon reaching the brake arrangement and the final vacuum conveying roll, have a predetermined position relative to the vacuum conveying roll and the brake arrangement. This predetermines that the sheets can be transported at a definite conveying speed from the sheet input to the sheet repository. A therefor suited transport arrangement has pneumatically operating suspension bars located above the plane of conveyance and which extend until over the respository, and a plurality of vacuum rolls spaced at about the length of a sheet which rotate at the conveying speed.

BRIEF DESCRIPTION OF THE DRAWINGS

Reference may now be had to the following exemplary embodiment of the invention, taken in conjunction with the accompanying drawings; in which.

DETAILED DESCRIPTION

Figure 1:
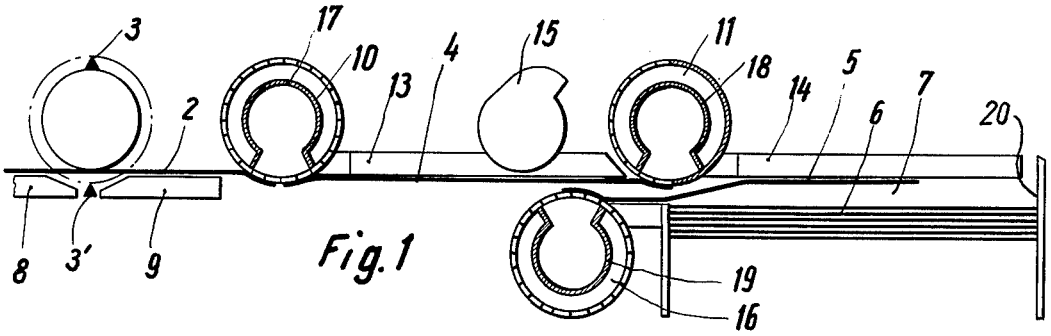
FIGS. 1 through 5 schematically illustrate in side view an arrangement for the stacklike depositing of equally long sheets in various operative phases thereof.
Figure 2:
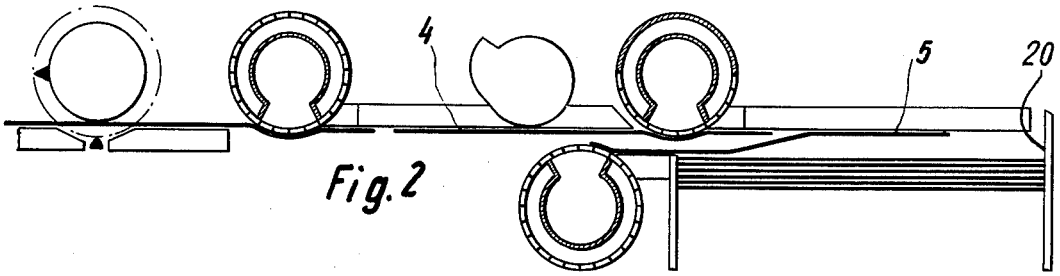

At the start of the transport path for the sheet there is provided an input in the form of a rotating cross cutter 1, which divides the web material 2 incoming from the direction of the arrow, through the intermediary of its rotating knife 3 and a stationary knife 3' into sheets 4, 5, 6 of equal lengths. At a constant infeed speed of the web material 2, the rotating cross cutter 1 runs at a constant speed of rotation.

The rotating cross cutter 1, in effect, conveys the sheets in rhythm into the transport path leading to the repository 7. In the region of the cross cutter 1, the web material is carried by suspension bars 8, 9 which are located beneath the plane of conveyance, having nozzles for blowing air against the underside of the web of goods 2. The blowing directions of the nozzles has a component directed in the conveying direction, so that the web of goods is transported by the blown air in the direction of the arrow.

Located along the conveying direction behind or downstream of the cross cutter 1 and above the plane of conveyance are two rotating vacuum conveying rolls 10, 11 which rotate at the same peripheral speed. The lower apex of the vacuum conveying rolls 10, 11 lies somewhat below the plane of conveyance for effecting the secure gripping of the sheets so that one can consider a tangent of the surface of the vacuum conveying rolls 10, 11 with the plane of conveyance. The spacing of the vacuum conveying roll 10 from the cross cutter 1, and the spacing between the vacuum conveying rolls 10, 11 is selected to be preferably somewhat smaller than a length of sheet, so that the transported sheets 4, 5, 6 are conveyed along the entire transport path at a definite speed imparted thereto by the vacuum conveying rolls 10, 11. The peripheral speed of the two vacuum conveying rolls 10, 11 is equal, and somewhat larger than the peripheral speed of the cross cutter 1 and the infeed speed of the web of goods 2, so that a spacing 12 is formed between the separate sheets. In the region of the transport path there are located suspension bars 13, 14 adjacent each other, which extend to above the sheet repository 7. From the suspension bars 13 emanates blow air which is oriented so as to exert on the sheets a transporting effect and concurrently an aspirating effect whereby the sheets are conveyed along floating distances.

The second vacuum conveying roll 11 located along the conveying direction is only perforated along a portion of its periphery so as to exert on the sheets only a suction-and transporting effect when its perforated portion faces towards the sheet. Located in the conveying direction immediately preceding the vacuum conveying roll 11 and above the plane of conveyance, are a plurality of cams 15 formed of spiral discs, which are mounted on a common shaft. The shaft rotates in rhythm with the introduction of the sheets and, consequently, in the same rhythm as the vacuum conveying roll 11. Below the plane of conveyance, and between the vacuum conveying roll 11 and the cams 15, there is positioned a vacuum brake roll 16 which rotates at a substantially lower peripheral speed in comparison with the peripheral speed of the vacuum conveying rolls 10, 11. In order that for the aspiration of the web of goods by means of the perforations in the vacuum rolls there is no loss of unused blow air, within the vacuum rolls there are positioned stationary deflectors 17, 18, 19, by means of which the suction air is aspirated only from the area of the roll surface portion facing towards the web of goods.

The inventive arrangement operates in the following manner:

The web of goods 2 is transmitted at a predetermined speed to the cross cutter 1, the latter of which rotates at a constant rotational speed. Each time when the rotating knife 3 comes into cutting engagement with the stationary knife 3', the web of goods sheet is cut through transversely so as to separate a sheet 4, 5, 6 therefrom. The cross cutter, in this manner, provides the rhythm for the sheets introduced into the conveying path. In lieu of the cross cutter there may also be employed a compression machine which, in a corresponding rhythm introduces the sheets into the conveying path. For the invention the type of sheet insertion is not essential as long as equally long sheets are introduced into the conveying path at a predetermined rhythm.

Figure 3:
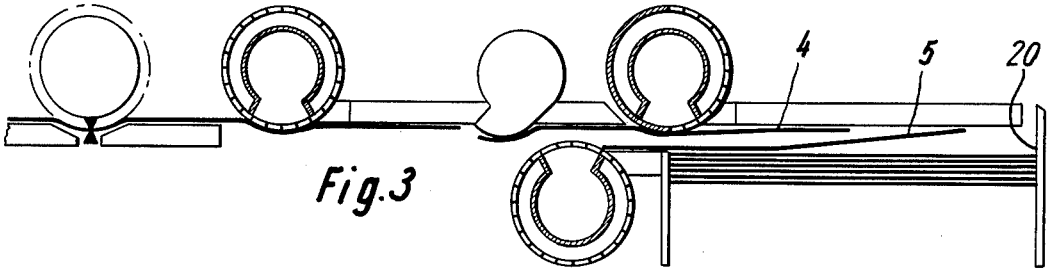
Figure 4:
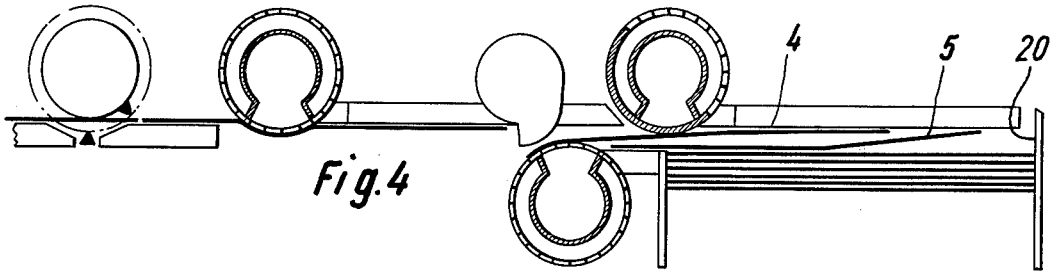
Figure 5:
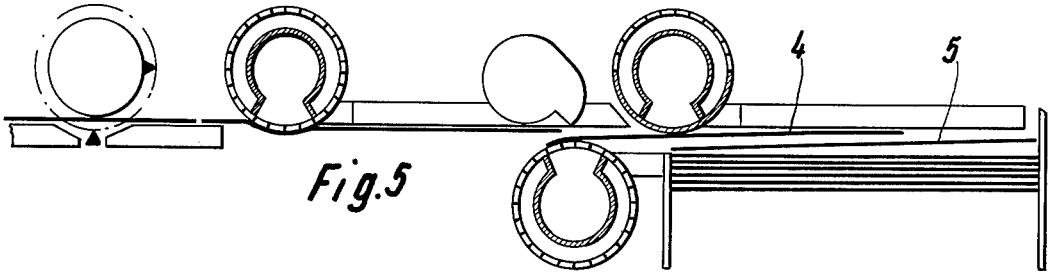

Even before a sheet is cut off, it is already subject to the effect of the first vacuum roll 10. As soon as the cut has been carried out, the transporting speed of the sheets is slightly increased to a definite speed which is determined by the conveying roll 10, so that between the sheet trailing end and the leading edge of the successive, still not cut off sheet there is formed a small space 12. This space 12 is created in order to afford, at a greater degree of assurance, that the portions of the arrangement which are responsible for the overlapping and braking actions do not concurrently exert an effect on the trailing end of one sheet and the leading end of a successive sheet. The sheet 4, which in this matter is moved apart from the leading end of the successive sheet so as to form a space, is then free-floatingly transported by the suspension bars 13 towards the vacuum conveying roll 11. Since the vacuum conveying rolls 10, 11 are located at a smaller mutual spacing than the length of the sheet, the leading end of the sheet 4 is engaged by the vacuum conveying roll 11 before its trailing end has left the range of effectiveness of the vacuum conveying roll 10. In this manner there is afforded that the sheet 4 is conveyed along its entire transport path at a speed imparted thereto by the conveying rolls 10, 11. The conveyance of the sheet with this definite speed and the rotation of the vacuum conveying roll 11 in rhythm or synchronism with the introduction of the sheets in the conveying path due to the cross cutter 1 is necessary so that the initial end of the sheet engages with the perforated area of the vacuum conveying roll 11. The periphery of the vacuum conveying roll 11 is so dimensioned, and its division into the perforated and unperforated portions so calculated, that the trailing end of the sheet 4 coincides with the unperforated portion, as shown in FIGS. 3 through 5 of the drawings. The unperforated portion of the vacuum conveying roll 11 facilitates the detaching of the sheet end from the vacuum conveying roll 11.

Figure 6:
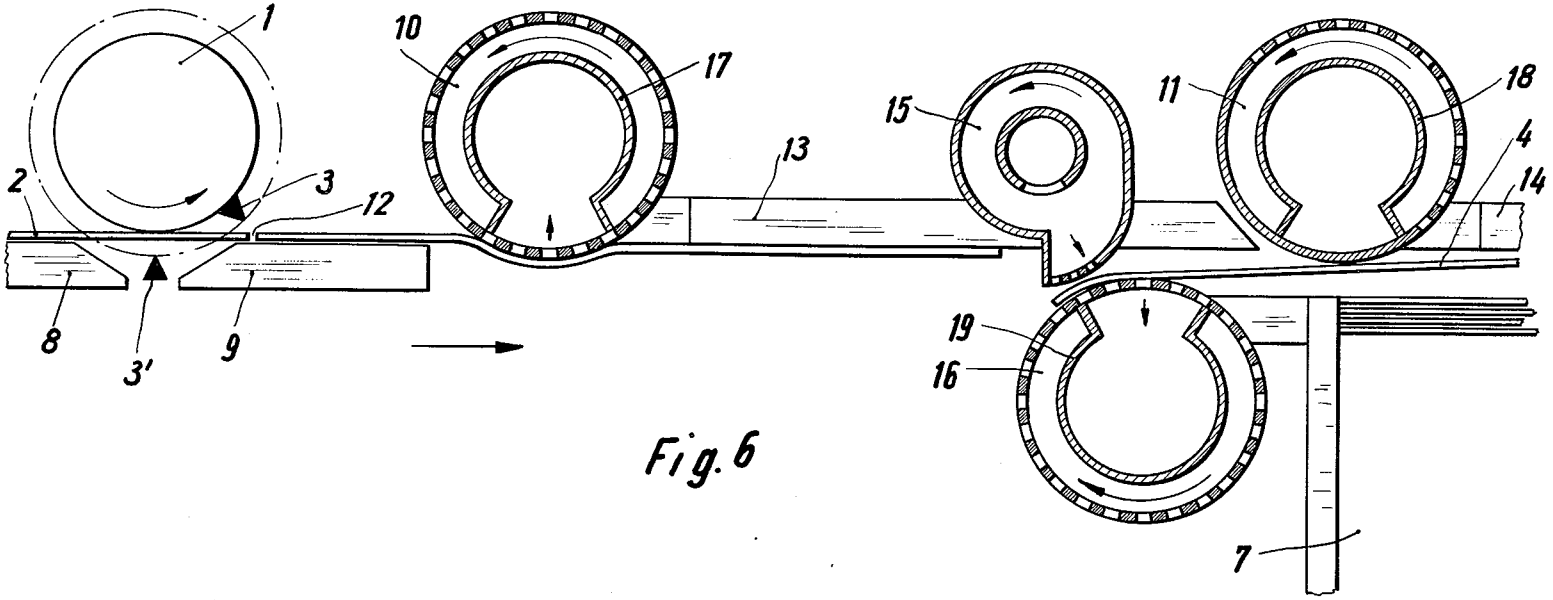
FIG. 6 shows the arrangement in the operative phase of FIG. 4, in an enlarged scale.

As previously mentioned, in spiral disc-shaped cams 15 rotate in same rhythm with the vacuum conveying roll 11. As long as the leading end of the sheet still stands under the effect of the perforated portion of the vacuum conveying roll 11, the cams 15 are located above the conveyor plane. However, as soon as the sheet end comes into the region of the vacuum conveying roll 11, and the unperforated portion of the vacuum conveying roll 11 faces towards the sheet, the cams extend into the plane of conveyance, and with their curvilinear backs press the end of the sheet downwardly and against the vacuum brake roll 16, which aspirates the sheet end and, due to its small peripheral speed, brakes the sheet from the end thereof while its leading end still lies under the conveying force exerted by the suspension nozzles 14, which is negligibly small as compared to the brake force. The downward deflection of the sheet end takes place quite easily, since during this sequence, the vacuum conveying roll 11 does not exert any aspirating effect on the end of the sheet. The deflection of the sheet end and the braking of the sheet is illustrated in FIGS. 3 through 5. In order to avoid any contact between the back of the cams and the sheet end, and in order to lend support to the brake roll 16, the cam back may mount blow nozzles, as shown in FIG. 6. In each instance the downward pressing of the sheet end is carried out without disturbance of the initial portion of the successive sheet, since the cams 15 rotate at a peripheral speed which is equal to the transporting or conveying speed. Moreover, they may have return-springing backs, as illustrated in the drawings.

When the sheets leave the vacuum brake roll with their ends, they still have a residual speed which is adequate to allow them to glide into a soft contact with a stop 20 of the repository 7. The removal of the sheet end from the surface of the vacuum brake roll 16 may be carried by a comb or scraper located downstream thereof.

As may be ascertained from FIGS. 1 through 5, in the region of the vacuum conveying roll 11, the vacuum brake roll 16, and the disc cams 15, the leading end of the successive sheet 4 may be slid over the trailing end of the presently braked sheet 5, without disturbing these sheets.

Since in the inventive arrangement no switching elements are provided, but only rotating elements, the sheets may be inserted into the arrangement at a high sequential infeed speed and stacked undisturbedly. Through the location of the vacuum conveying roll 11 in the region of the sheet input, the sheets may be transported at a high and definite speed until far above the repository, and the braking path and the path having reduced speed be selected extremely short that the floating or suspending ability is maintained through air lubrication and thin papers will not cause any difficulties. Since all of the conveying, deflecting and brake elements coming into contact with the sheets do not have any relative motion with respect to the sheets which are being transported, the sheets cannot be charged electrostatically in response to any metallic construction of these elements. The stationary suspension bars cannot cause any electrostatic charging, since they maintain the sheets in a suspended relationship without contact therewith. The electrostatic charging of the sheets caused by previous processing are even reduced upon passage through the inventive arrangement. Even from this viewpoint an undisturbed stacking of the sheets with mutual overlapping is facilitated during depositing. Since the sheet during braking is braked from one end thereof, even during depositing no coiling of the material can occur. Finally, and of particular importance to the invention, at high speeds there is provided an assured separation between the effects of the vacuum conveying roll and the brake roll and the therewith associated cams so that in itself at high sequential feed speeds only either the conveying elements or the brake elements exert an effect on the same sheet.

Within the scope of the invention it is also possible that in lieu of the suspension bars and the first vacuum conveying roll there be employed other conveying means, such as belts or webs. In lieu of the second vacuum conveying roll there may also be provided one suction conveying web or the like. In lieu of the vacuum brake roll there may also be provided another brake arrangement, for example, a stationary vacuum box.

While there has been shown what is considered to be the preferred embodiment of the invention, it will be obvious that modifications may be made which come within the scope of the disclosure of the specification.

What is claimed is:

1. In an arrangement for the stackwise depositing of separate equally long sheets, including a sheet transporting arrangement having at least one rotatable vacuum conveying means, said transporting arrangement being adapted to convey successively inserted sheets from an input to a repository at a predetermined conveying speed and in a predetermined plane of conveyance; a brake arrangement located along the path of conveyance upstream of said repository for deflecting an end of each sheet downwardly out of the plane of conveyance so as to reduce the conveying speed to a speed facilitating an undisturbed depositing of said sheets in said repository; and means for interrupting the suction effect of the vacuum conveying roll located proximate said braking arrangement during effective periods of the latter, the improvement comprising: said rotatable vacuum conveying means proximate said brake arrangement being perforated along a portion of its periphery and being rotated in rhythm with insertion of said sheets so that the perforated peripheral portion of said rotatable vacuum conveying means rotates in synchronism with the leading portion of each said sheet and the unperforated portion thereof faces towards the end of each said sheet upon the end of the sheet being in the effective region of the operative brake arrangement in rhythm with said sheet insertion.

2. Arrangement as claimed in claim 1, said brake arrangement comprising a vacuum roll having a peripheral speed lesser than the conveying speed imparted to said sheets by said vacuum conveying roll.

3. Arrangement as claimed in claim 1, said brake arrangement comprising rotatable cam means position positioned above the plane of sheet conveyance, said cam means extending into the plane of conveyance upon each rotation for effecting downward deflection of each sheet end.

4. Arrangement as claimed in claim 3, said cam means comprising spirally-shaped discs.

5. Arrangement as claimed in claim 3, said cam means supporting blow nozzles for directing a stream of air against said sheets.

6. Arrangement as claimed in claim 1, said vacuum conveying roll being located in the conveying direction of said sheets downstream of said brake arrangement.

7. Arrangement as claimed in claim 1, said transporting arrangement comprising pneumatically operating suspension bars above said plane of conveyance extending over said repository; and a plurality of said rotatable vacuum conveying means spaced at about the length of a sheet and rotating at the sheet conveying speed.

8. Arrangement as claimed in claim 1, said rotatable vacuum conveying means comprising a roll.

* * * * *